US007624843B2

(12) United States Patent
Cresswell

(10) Patent No.: US 7,624,843 B2
(45) Date of Patent: Dec. 1, 2009

(54) MULTIPLE TASK WORKING PLATFORM

(76) Inventor: Ted A. Cresswell, 811 Church Rd., Mifflinburg, PA (US) 17844

( * ) Notice: Subject to any disclaimer, the term of this patent is extended or adjusted under 35 U.S.C. 154(b) by 657 days.

(21) Appl. No.: 11/319,863

(22) Filed: Dec. 27, 2005

(65) Prior Publication Data

US 2007/0144832 A1 Jun. 28, 2007

(51) Int. Cl.
*E04C 5/00* (2006.01)

(52) U.S. Cl. ..... 182/63.1; 182/127

(58) Field of Classification Search ..... 182/127, 182/63.1; 280/6.15, 6.153
See application file for complete search history.

(56) References Cited

U.S. PATENT DOCUMENTS

| | | | | |
|---|---|---|---|---|
| 650,900 | A | 6/1900 | Knopfe | |
| 2,360,999 | A | 10/1944 | Wyen | |
| 3,071,204 | A | 1/1963 | Piltingsrud | |
| 3,480,110 | A | 11/1969 | Coleman | |
| 3,850,264 | A | 11/1974 | Solinas | |
| 4,000,789 | A | 1/1977 | Zahner | |
| 4,216,933 | A * | 8/1980 | Cramer, Jr. | 248/188.5 |
| 4,662,476 | A | 5/1987 | Ross | |
| 4,877,107 | A * | 10/1989 | Anderson | 182/17 |
| 4,886,139 | A | 12/1989 | Dupont et al. | |
| 4,919,230 | A | 4/1990 | Langer et al. | |
| 5,564,523 | A * | 10/1996 | Howard | 182/63.1 |
| 5,819,872 | A * | 10/1998 | Krause | 182/17 |
| 6,431,314 | B1 * | 8/2002 | Boulanger et al. | 182/63.1 |
| 6,533,067 | B2 * | 3/2003 | Chick | 182/16 |
| 6,539,881 | B2 | 4/2003 | Underbrink et al. | |
| 6,880,672 | B2 * | 4/2005 | Imberi | 182/13 |

* cited by examiner

*Primary Examiner*—Katherine W Mitchell
*Assistant Examiner*—Candace L. Bradford
(74) *Attorney, Agent, or Firm*—Thomas R. Shaffer

(57) ABSTRACT

A multiple task mobile working platform having a generally rectangular platform frame is provided. An adjustable scaffold leg member support allows for attachment of a variety of scaffolds of different dimensions. An angled tubular bracket allows for attachment of legs members in different positions to allow for maximum stability where there is sufficient space and for a more compact foot print when the working platform must be placed close to a building or object. Precise leveling of the working platform, removable safety side rails and an optional trailer are also disclosed.

16 Claims, 7 Drawing Sheets

MULTIPLE TASK WORKING PLATFORM

BACKGROUND OF THE INVENTION

1. Field of the Invention

This invention relates generally to the field of working platforms and scaffolds. More specifically it relates to a working platform which allows for the adjustable attachment of scaffolds and the adjustable attachment of various platform leg members.

2. Description of the Prior Art

Scaffolds are used for a variety of purposes in the building construction and maintenance trades, such as painting, plastering, electrical, masonry, carpentry, etc. Once erected, scaffolds are difficult to move throughout a job site without disassembly. U.S. Pat. No. 2,360,999 to Wyen, attempted to solve this problem by adding rollers on the bottom of the scaffolds. Although the scaffolds can be rolled from location to location within the job site, the ground on which the scaffolds are rolled has to be relatively flat for the scaffold to properly roll such as interiors of concrete warehouses, for example. When the device is used on uneven surfaces, such as rough excavated ground surfaces, it becomes difficult to maintain a safe foundation for use of the device. The Wyen device also requires the scaffolds to be lifted off the rollers by using jack screws when a desired position is located.

Another device, shown in U.S. Pat. No. 4,216,933 to Cramer, shows a similar scaffold platform, but it too has deficiencies in its leveling process. Its vertical leveling corner supports require either a forklift, or similar piece of lifting machinery or actual man power to lift the platform to an elevation suited for use. The rigid vertical supports on this device have pre-drilled/pre-measured holes, where a pin is inserted for final adjustment. This requires the user to occasionally level the loose ground or use a leveling block under one or several of the corner supports. This arrangement could create a safety hazard to the overall stability of the unit if one or more of the leveling blocks would move or slide from under one of the vertical supports during usage.

The most common solution for mobility is to provide for an easily disassembled scaffold. An example of such a device is shown in U.S. Pat. No. 650,900 to Knopfe. This device is made of simple and interchangeable parts adapted to be quickly assembled and disassembled for transportation and movement within a job site. This unit uses adjusting shoes attached to the lower base beams for leveling on uneven surfaces. U.S. Pat. No. 3,071,204 to Piltingsrud also has adjustable legs as well as a variable length. Other mobility solutions but limited, are shown in U.S. Pat. No. 3,480,110 to Coleman and U.S. Pat. No. 3,850,264 to Salinas. In both designs, the devices provide for horizontal members extended from the main scaffolds on which a second platform is constructed. Instead of moving the scaffolds, they are extended. Both designs also have adjustable supporting legs and use a disassembly method for major mobility when in use.

Many of the above mentioned designs have adjustable supporting legs and some have extended horizontal members. Some of these designs use a disassembly method of the scaffolds for mobility purposes. The present invention will allow its unit to be moved while scaffolds are erected, together with tools and material being stored on the working platform, along with the safety side rails installed. This will allow the user to not only move the scaffolds without disassembly but also transport the tools and material needed for the job at hand.

While the prior art patents mentioned earlier offer some form of leveling support legs, the present invention utilizes screw type leveling jacks which allow exact leveling without the need for filler blocks which are required with the pre-drilled designs. Although several of the designs offer removable supporting legs, they are limited to only a few positions in which the supporting legs and supports can be positioned. This could cause difficult placement of the scaffold to a building or object when close confinement is inevitable. The present invention offers two positions for its screw jack bracket.

None of the prior art patents teach or suggest a movable scaffold base member to allow an in/out and circular side by side movement in their scaffold bases. The prior art devices are limited and can only be used with certain scaffolds offered in today's market due to size and adjustment confinements in accepting the vertical scaffold legs. The present invention offers an adjustable scaffold base allowing the majority of all scaffold designs which are using a four vertical leg support design to be used.

Without the supporting floor and safety rails, none of the previous mentioned patents can be used as an independent movable working platform, whereas this invention provides a safe and structurally secure working platform.

SUMMARY OF THE INVENTION

The present invention provides a working platform (referred to as the main platform) which can be leveled at ground level by hand turning the screw jacks located at all four corners. The safety side rails will allow the unit to become a mobile working platform by using a forklift or a similar type of equipment. This invention will also allow the user to level the working platform on stable ground and erect multiple sections of scaffolds horizontally which can be then moved in a fully assembled form to various locations on a job site. If the invention is being used on a hard and level surface such as concrete, optional rollers can be attached to the unit in place of the hand screw jacks. This will enable the unit to be "rolled" freely on top of the hard, level surface. The provision of a licensed trailer specially designed to secure a working platform permits the user to transport the unit to and from a job site. The working platform also provides additional space to haul tools and materials to a job site.

The present invention provides adjustable attaching means located near each of said four corners which in one embodiment of the invention comprises an adjustable scaffold leg member support which includes adjustable base plates to secure multiple level scaffolds.

A main platform is preferably provided with safety side rails which permit the invention to be used for a variety of tasks. Although many of the prior art devices are based on a mobile scaffold base design, the present invention can be used to establish a safe and secure mobile working platform which can be elevated to required heights to complete the job at hand by the use of a forklift or the like.

Depending on the actual job being completed, many manufactures require different distances between the bottom supports of their scaffold. The present invention offers adjustable base plates which allow the present invention to be used with a majority of the scaffolds offered in today's market.

The present invention provides novel adjustable screw leveling corner jacks which enable the user of said invention to level the main platform on uneven surfaces at any elevation.

Such a design is a great improvement over the prior art which offers pre-drilled/pre-determined adjustable heights in their supporting vertical supports often requiring shims or blocks for leveling.

The present invention provides adjustable attaching means located near each of said four corners which in another preferred embodiment of the invention comprises angled tubular brackets which support the corner screw jacks. The angled tubular brackets are reversible and can be positioned in an outward or in an inward position. The inward position allows the working platform to be placed directly against a wall or work area assuring a safe environment since there will be little or no distance between the platform and object being worked on. When the invention is not attached to a forklift or the like, the unit can become its own working platform on level or uneven terrain.

With the main platform secured to a licensed trailer, the unit can be towed to and from a job site utilizing existing highway systems. The trailer also provides a means for the user to transport the tools and material to said job while the main platform is secured to the trailer.

In its simplest form, the present invention provides a multiple task mobile working platform comprising: a generally rectangular platform frame having four corners, a pair of spaced apart tubular end members, a pair of spaced apart tubular side members and plural spaced apart cross bar members extending between said side members, said frame adapted for use in a generally horizontal orientation; and adjustable attaching means provided near each of said four corners of said frame, each attaching means adapted to removably secure a functional vertical member to said frame in a selected one of a plurality of locations.

Preferably, said frame member and said crossbar members are formed from thick steel box tubing and are welded together and a floor member is provided to cover an upper side of said frame. Preferably, the floor member is formed from a thick steel mesh.

In one embodiment, said adjustable attaching means comprises an adjustable scaffold leg member support, said scaffold leg member support member being movable and adjustable to permit a user to selectively install any one of a variety of commercially available scaffolds onto the working platform. Preferably, said adjustable scaffold leg member support is bolted onto said frame and includes a base plate having an elongated opening therein and a vertically extending tubular post member adapted to receive and support a leg of a scaffold. Preferably, a screw member is threaded into said tubular post member whereby turning said screw member tightens a leg of a scaffold firmly into said tubular post member and further secures a scaffold on said frame.

In another embodiment, said adjustable attaching means comprises an angled tubular bracket which is removably inserted and attached to said frame. The angled tubular bracket has an insertion end and an extension end, said extension end extending from said insertion end at an angle of between 100° and 170°. Preferably, said angle is approximately 135°. Said angled tubular bracket is reversible and extends outwardly away from a longitudinal centerline of said frame when inserted in a first position and extends inwardly towards a longitudinal centerline of said frame when inserted in a second upside down position. Preferably, said angled tubular bracket further comprises a frame leg support bracket mounted for rotational movement on said extension end. Preferably, said frame leg support bracket is attached to a frame leg in the form of an adjustable screw leveling corner jack which permits the working platform to be leveling on uneven surfaces. Alternatively, said frame leg support bracket may be attached to a frame leg having a wheel on a lower end thereof. Preferably, said frame leg support bracket selectively secures a frame leg to the frame in a vertical position for use on the ground and in a horizontal position for storage or use above the ground.

Preferably, the present invention utilizes adjustable attaching means which comprises both an adjustable scaffold leg member support and which further comprises an angled tubular bracket. Such an arrangement provides an enormous amount of flexibility in the use of the working platform.

Preferably, said frame further comprises a pair of horizontal fork tubes mounted below the frame, said fork tubes being sized and spaced to receive fork tines of a fork lift whereby the platform may be lifted above the ground by a fork lift. Preferably, said frame further comprises plural safety rail brackets and said platform further comprises removable safety rails which surround an individual while using the working platform.

Finally, the present invention also preferably further comprises a trailer to which the working platform can be secured for the purpose of transporting the working platform and any scaffolds or equipment secured to or positioned on the working platform.

DETAILED DESCRIPTION OF THE PREFERRED EMBODIMENTS

Figure 1:
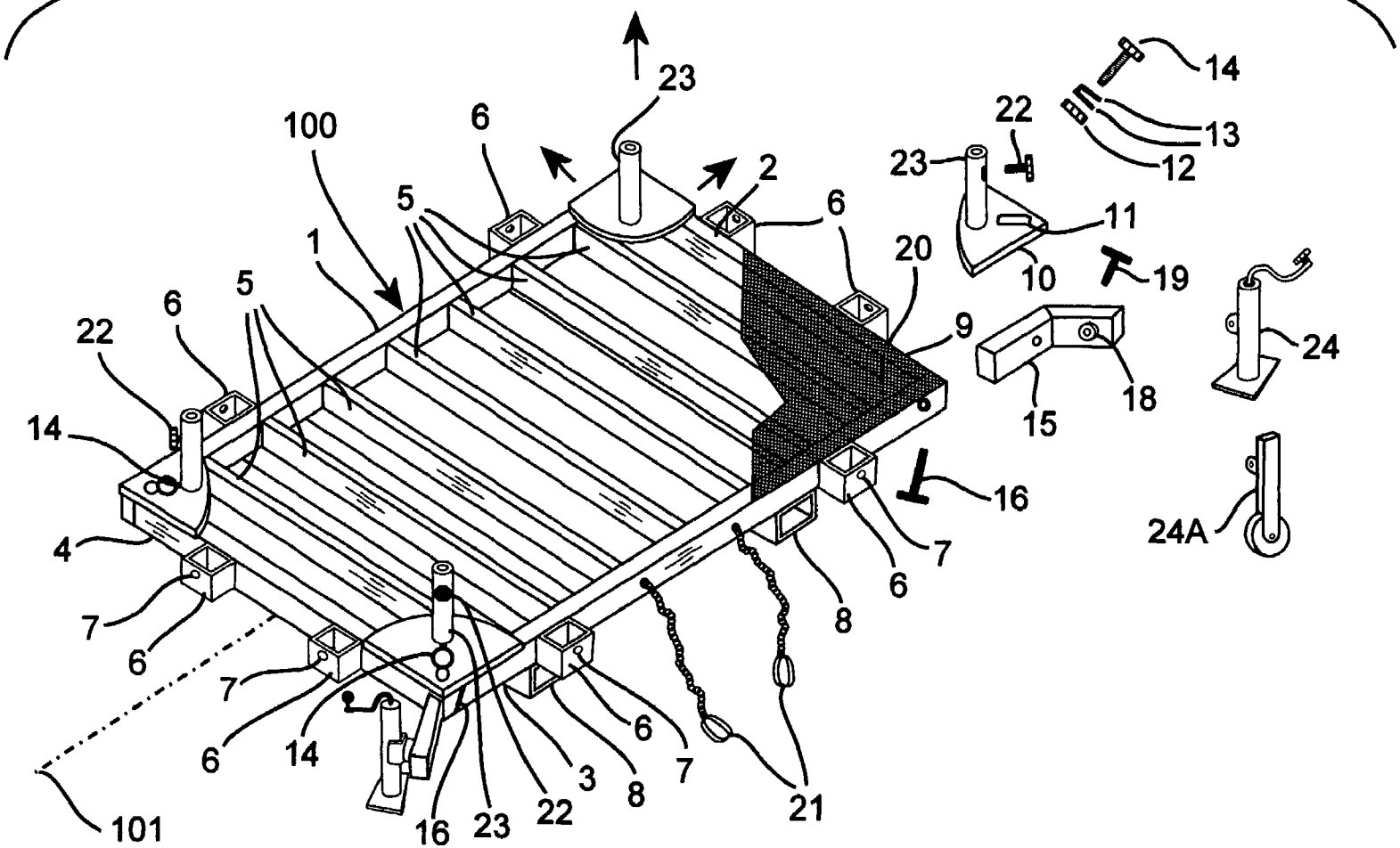
FIG. 1 is a perspective view of the main platform frame of the present invention having horizontally and vertically adjustable support legs with adjustable base plates for the erection of scaffolds.

Referring to FIGS. 1-7, the presently preferred embodiments of the present invention are depicted. In FIG. 1, a standard sized 5'-6"×8' portable working platform and scaffold support base referred to as the main platform is shown. The main platform comprises of a rectangular frame 100 formed by 3"×4"×⅜" thick box steel tubing members 1, 2, 3 and 4 which are welded together at each of their ends. Reinforcing the rectangular working platform are seven cross bars 5, which are made up of rectangular 2"×4"×⅜" thick steel box tubing. All seven cross bars 5 are equally spaced and in a parallel spacing between the outside frame end tubes 2 and 4. Each of the seven cross bars 5 are welded on each of their ends to the outside side frame tubes 1 and 3. The main platform frame has a longitudinal center line 101.

Figure 2:
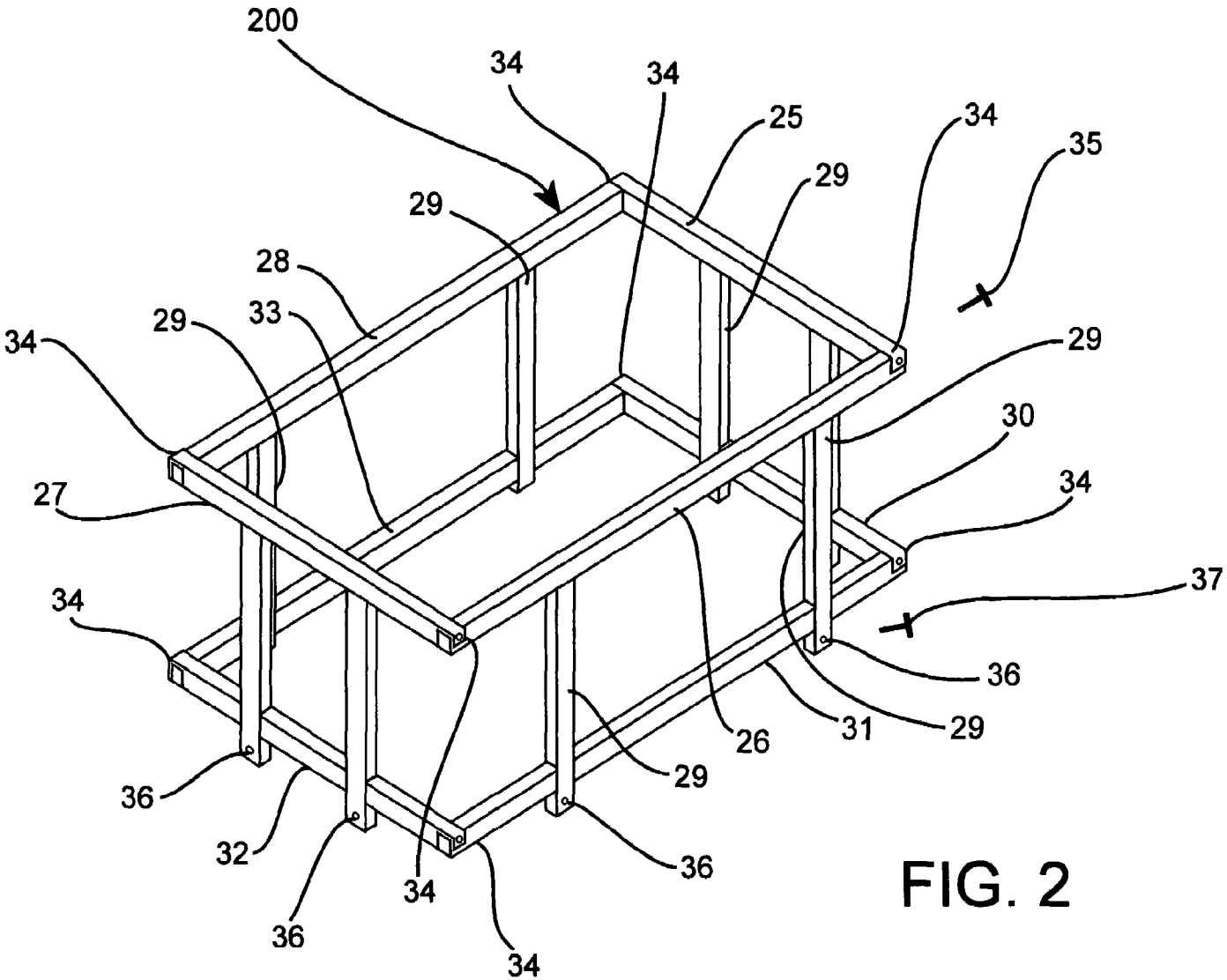
FIG. 2 is a perspective view of an embodiment of a safety side rail design to be installed on FIG. 1 when the main platform frame is being used as a working platform.

Eight sleeves 6 are fabricated from ⅜" flat steel and are sized to receive the bottom of vertical posts 29 of safety rails 200 (FIG. 2). Once the eight sleeves 6 are bent to shape they are drilled with a 9/16" drill creating holes 7 which will accept the securing "T" handled pins 37. Once the holes 7 are drilled, then all eight sleeves 6 are spaced, with two sleeves 6 per outside frame tubes 1, 2, 3 and 4 to assure proper spacing to accept the insertion of the vertical support posts 29 of the safety side rails 200 shown on FIG. 2. Once properly spaced, the eight sleeves 6 are welded on the outside frame tubes 1, 2, 3 and 4.

Two rectangular 3"×5"×½" thick horizontal fork tubes 8 are cut to a 5'-6" length for the purpose to receive the insertion of forks of a forklift or the like and once the fork tubes 8 are cut to length, they are spaced at 3'-6" apart in a parallel position centered from outside frame tubes 2 and 4. Once the fork tubes 8 are positioned, they are welded on both ends to the bottom side frame tubes 1 and 3 and any adjoining cross bars 5.

Four ⅜" thick steel angled corner braces 9 are fabricated and drilled to accommodate a ½" course thread bolt 14, ½" flat washers 13 and a ½" course thread nut 12. The four angled corner braces 9 are then welded to each of the outside frame tubes 1, 2, 3 and 4 (as shown on FIG. 1).

A ¼" thick steel meshed floor 20 is sized to the perimeter of the outside frame tubes 1, 2, 3 and 4. Once cut to size, the floor 20 is placed on the top side of the outside frame tubes 1, 2, 3 and 4 and seven cross bars 5 and welded with a minimum of six inch spacing at all intersecting points to said frame tubes 1, 2, 3 and 4 and cross bars 5.

An adjustable attaching means in the form of an adjustable scaffold leg member support includes a scaffold base plate 10 and is fabricated starting with a 90 degree ½" thick piece of steel, with two of the sides of said plate to be a minimum length of 12". The third side of the scaffold base plate 10 is cut on a slow outside radius. The scaffold base plate 10 is sized and notched with an elongated opening 11 to accommodate the diameter of the bolt 14, creating an in/out and circular side by side adjustable motion at the corner of said scaffold base plate 10. Following the cutting of the scaffold base plate 10, a 2" outside diameter, ⅜" thick steel pipe 23 is cut to an 8" length. Once the steel pipe 23 is cut, a hole is drilled and threaded to accommodate a ½" course thread bolt 22 used to secure the bottom portion of a scaffold vertical leg. The steel pipe 23 is centered between the end of the opening 11 and the edge of the radius of the scaffold base plate 10 and welded in a perpendicular position on the scaffold base plate 10. Finally, the four assembled scaffold leg member support base plates 10 are mounted at each corner of the main platform 100 and attached to said platform through the four ⅜" thick steel angled corner braces 9 previously welded by asserting the bolt 14, washers 13 and nut 12.

An adjustable attaching means in the form of four angled tubular brackets 15, which are the supports for attaching the adjustable screw leveling corner jacks 24 or, alternatively, the 360 degree rotating rollers 24A, are fabricated. Each angled tubular bracket 15 has an insertion end which is designed to slide into each corners of the working platform at the ends of the box steel tubes 1 and 3. The angled tubular brackets 15 are secured into a locking position with a ½" "T" handled pin 16 which is inserted into a 9/16" diameter drilled holes found on each corner of the main platform 100 through a pre-drilled hole found on the angled tubular brackets 15. To fabricate angled brackets 25, you begin with a tubular piece of steel sized to slide into each end of the tubes 1 and 3. Said steel is then cut in half on one end at a 22½degree angle with a straight cut on the other end, whereas the other piece is cut on both ends at 22½degree angles. Once cut, the 22½degree angled cut ends of the angled tubular brackets 15 are welded together creating a 45 degree welded angle. On the straight cut insertion end of the bracket 15, a 9/16" hole is drilled to match the 9/16" pre-drilled holes on both ends of tubes 1 and 3. This allows the ½" diameter "T" handled pin 16 mentioned earlier to be inserted to secure the bracket 15. On the other extension end of the bracket 15, a 2" long, 1¼" diameter, ¼" thick pipe 18 is welded on the bracket 15. A 9/16" hole 119 is drilled and matched into said pipe 18 to allow the adjustable screw leveling corner jacks 24 to be secured with a ½" "T" handled pin 19 when inserted. The insertion end and extension end of bracket 15 are joined at a 135° angle.

Two safety chains 21 used to secure the main platform to the forklift or the like are fabricated. First, two ⅜" thick link chains 21 are cut to a 2' length each. Then one ⅜" thick snap ring is placed on one end of each 2' safety chain 21. Once the snap rings are installed, the other end of each safety chain 21 is welded three inches towards the center of rail 3 from the inside of each forklift rectangular tube 8.

The safety side rails 200 of FIG. 2 are optionally attached to the main platform FIG. 1 by sliding the vertical side posts 29 into the two sleeves 6 found on each side tube 1, 2, 3 and 4, are fabricated from 2"×3"×⅜" thick box steel. First the top rails 25, 26, 27 and 28 are cut to a length to assure a proper measurement in order to fit outside the main platform. Then the ends of rails 25 and 27 are notched and a flange 34 is bent in a 90 degree downward angle. The notched flange 34 allows both ends of the 25 and 27 rails to fit over rails 26 and 28 and to be secured with a ½" "T" handled pin inserted in a pre-drilled 9/16" hole drilled through the flange 34 and the ends of rails 26 and 28. Once the four top rails 25, 26, 27 and 28 are completed, eight vertical posts 29 are fabricated from 2"× 3"×⅜" thick box steel at a 43" length each. Then two vertical posts 29, spaced to slide into the sleeves 6 are welded per each top rail 25, 26, 27 and 28. Once the vertical posts 29 are welded to the top rails, a 9/16" hole is measured and drilled at the bottom of each post 29 to assure an exact alignment allowing a ½" "T" handled pin to be placed through the said 9/16" hole and the hole 7 previously drilled in the sleeves 6. Once the 9/16" holes are drilled on the bottom section of each vertical post 29, the bottom rails 30, 31, 32 and 33 are fabricated by following the same procedure used when the top rails 25, 26, 27 and 28 were made, but one exception in the design of the bottom rails 30, 31, 32 and 33 from the top rails 25, 26, 27 and 28 is apparent. Each vertical post 29 runs continuous through the bottom rails 30, 31, 32 and 34. This requires the bottom rails 30, 31, 32 and 34 to be cut into three spaced sections to complete the full length measurement required. Also rails 30 and 32 require the same flange and 9/16" hole 34 design as is found on rails 25 and 27. Once the bottom rails 30, 31, 32 and 33 are cut to size and flanges 34 are drilled, each appropriate section of the bottom rails 30, 31, 32 and 34 are welded to the vertical posts 29 at a six inch distance from the bottom of each vertical post 29.

Figure 3:
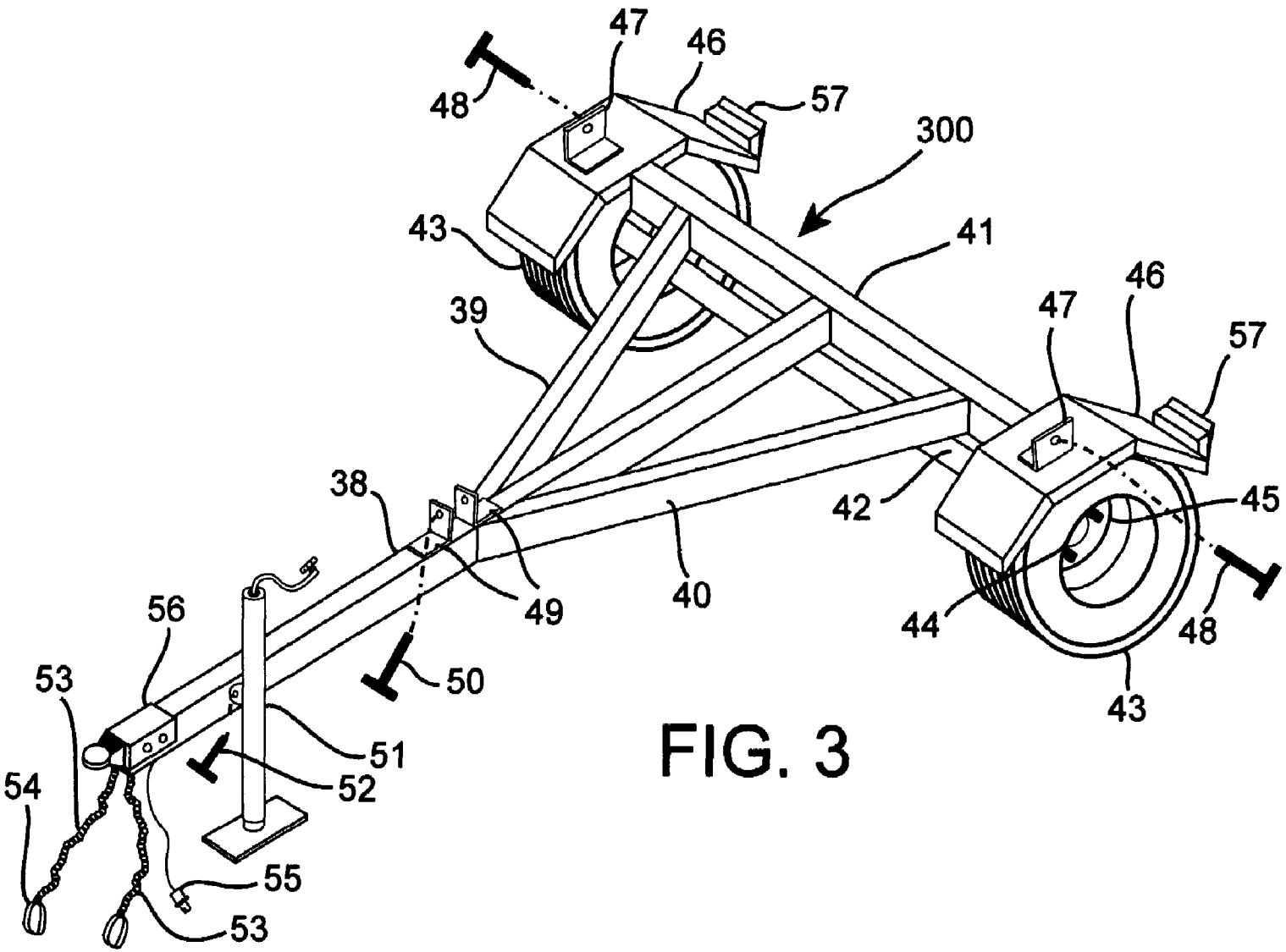
FIG. 3 is a perspective view of a licensed trailer used to transport the main platform frame of FIG. 1 and side rails of FIG. 2.

The next item to be fabricated is the trailer which is shown in FIG. 3 in which the main platform FIG. 1 and safety side rails FIG. 2 can be transported to and from job sites along with the ability to transport the unit within a job location. A center beam 38 fabricated from a 3"×4"×⅜" thick piece of tubular steel and cut at an overall length of 96". A rear cross member 41, also a 3"×4"×⅜" thick piece of tubular box steel, is cut at a 72" length. The center beam 38 is placed in the center of the rear cross member 41 in a perpendicular angle and welded to the rear cross member 41. Once the center beam 38 and rear cross member 41 are welded, two angle braces 39 and 40, also 3"×4"×⅜" pieces of tubular box steel, are cut with the appropriate angle shown on FIG. 3. Immediately after the angle braces 39 and 40 are completed, they are positioned as shown on FIG. 3 and welded to the center beam 38 and the rear cross member 41. The axle assembly, made up of a 7,000 pound capacity axle 42 equipped with a rubber suspension including two 7" wide×15" diameter wheels 44 covered with a 200/75R15 tires 43 which are secured to the axle 42 by five lugs 45 per wheel, are all installed to the base of the rear cross member 41 with supporting brackets. Following the axle assembly installation, the front screw jack 51 is installed 14" back from the end of the center beam 38 by inserting over a receiving collar resembling the 2" long, 1¼" diameter, ¼" thick pipe 18 welded on bracket 15 shown on FIG. 1. Screw jack 51 is then secured on the center beam 38 with a "T" handle pin 52 when placed over the receiving collar 18. Two fenders 46 are installed on the rear cross member 41. To the rear of each fender 46, tail lights 57, required for licensing the trailer are installed. The required wiring from the rear tail lights 57 is then attached under each fender 46 and pulled through the center of each appropriate angle brace 39 and 40 and continued through the center beam 38 to the front of the trailer, with a 20" piece of wire harness extending past the end of the trailer. On the end of the extended wire harness, an electrical male 12 volt trailer plug 55 is connected.

A 2" trailer ball receiver 56 is then attached on the front of the center beam 38 by drilling two 9/16" holes through the receiver 56 and center beam 38. Once drilled, two ½" course threaded bolts are inserted all the way through the receiver 56 and center beam 38. Two ½" flat washers are placed on the bolts, with two ½" Nylock, course thread nuts tightened on said bolts. Following the attachment of the receiver 56, two-⅜" thick links, 24" in length safety chains 53 are bolted with ⅜" nuts and bolts to the front and bottom of the center beam 38. Attached on each end of the safety chains 53 is a snap ring which is used to attach said trailer to the towing vehicle. Finally, 3"×3"×½" thick steel angle securing plates 47 and 49 are cut and then placed as shown on FIG. 3 to accept the main platform FIG. 1. Once the securing plates 47 and 49 are in position, they are then welded into position (the angle securing plates 47 onto the fenders 46 and the angle securing plates 49 onto the center beam 38).

When the user plans to transport the main platform FIG. 1, said main platform is placed on the trailer FIG. 3 and secured with two "T" handled pins 48 in the rear through the securing plates 47 and one "T" handled pin 50 through the securing plates 49.

Figure 4:
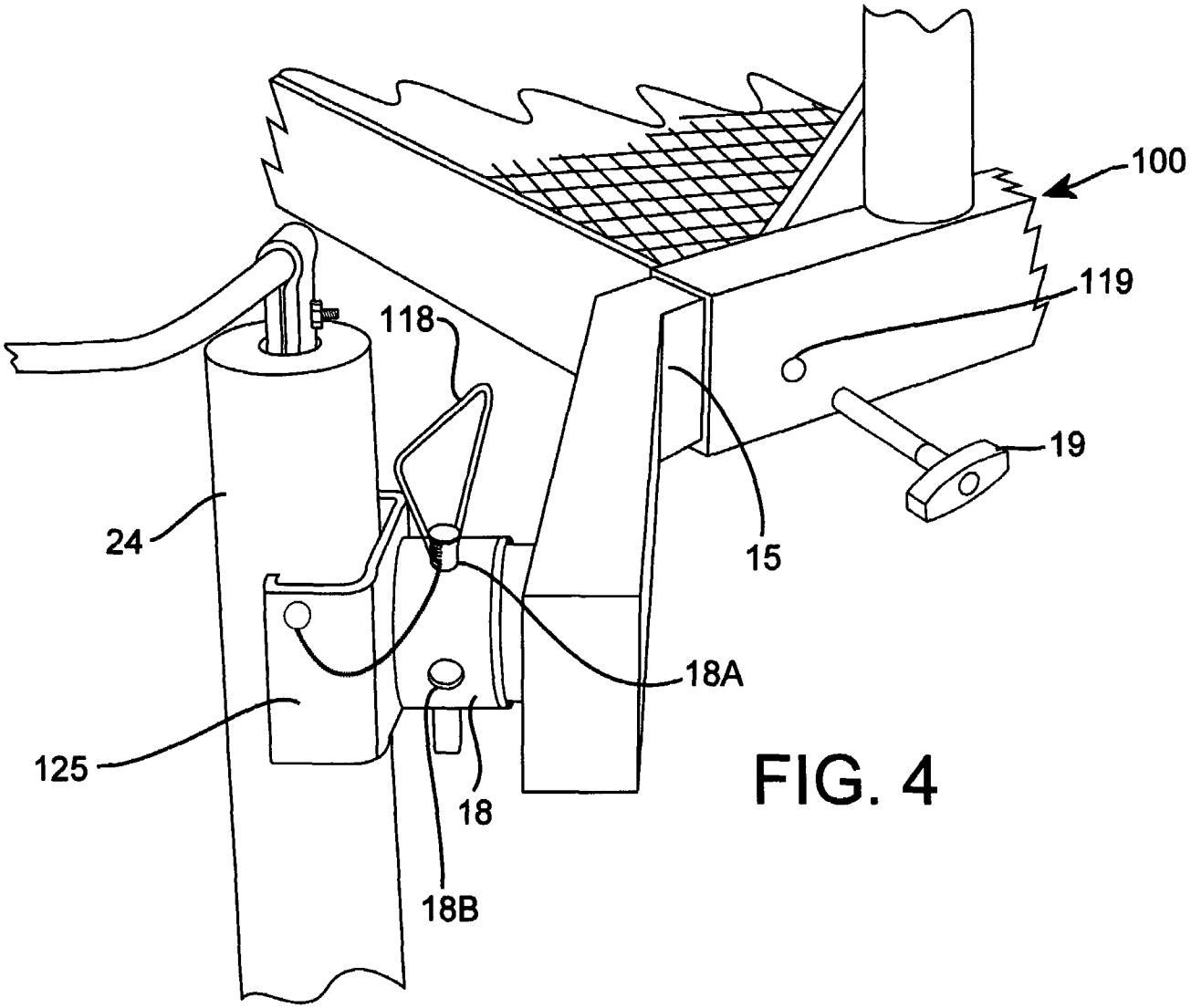
FIG. 4 is a perspective view of an angled bracket in an "out" position and a screw jack leg in a vertical position.
Figure 5:
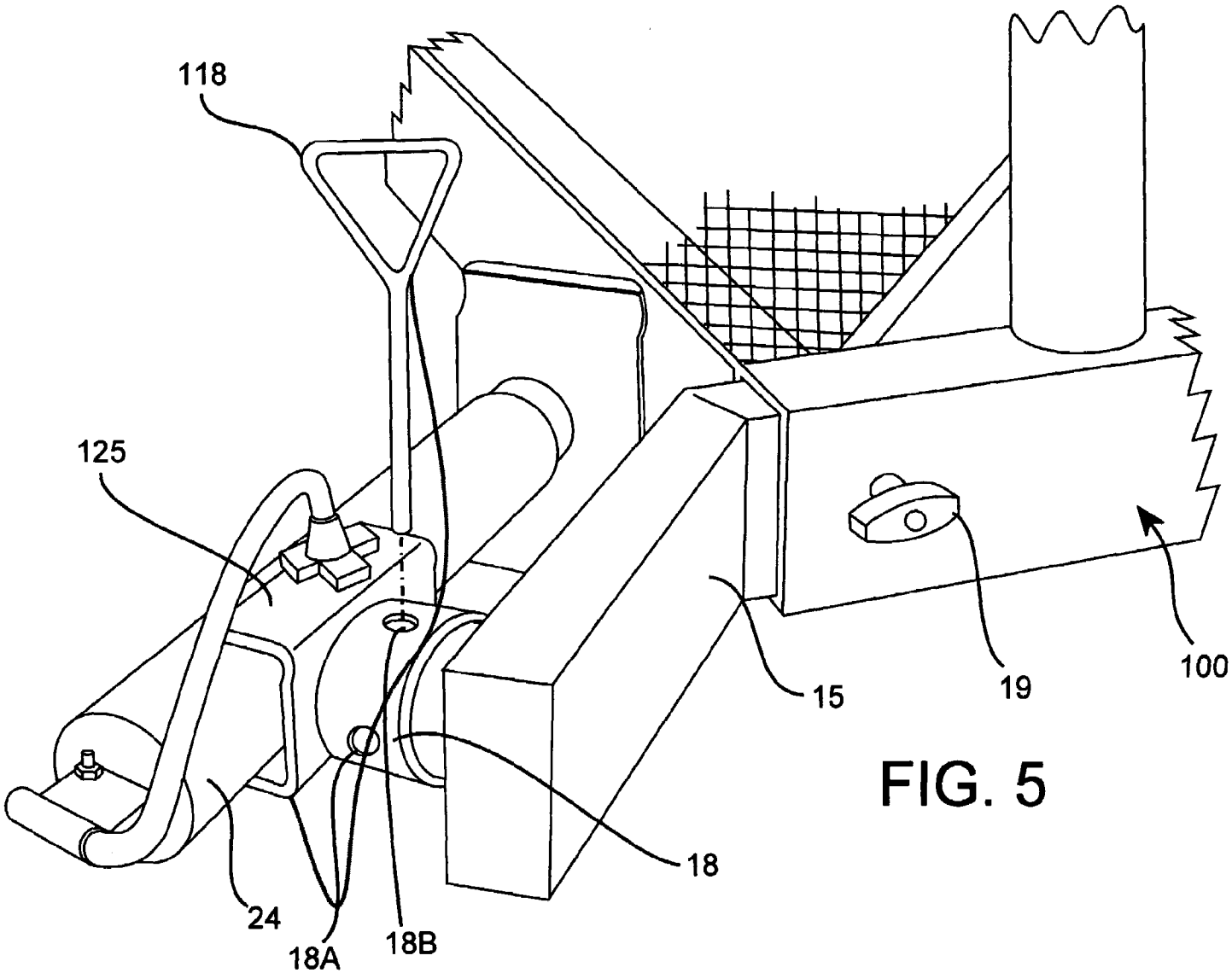
FIG. 5 is a perspective view of an angled bracket in an "out" position and a screw jack leg in a horizontal position.
Figure 6:
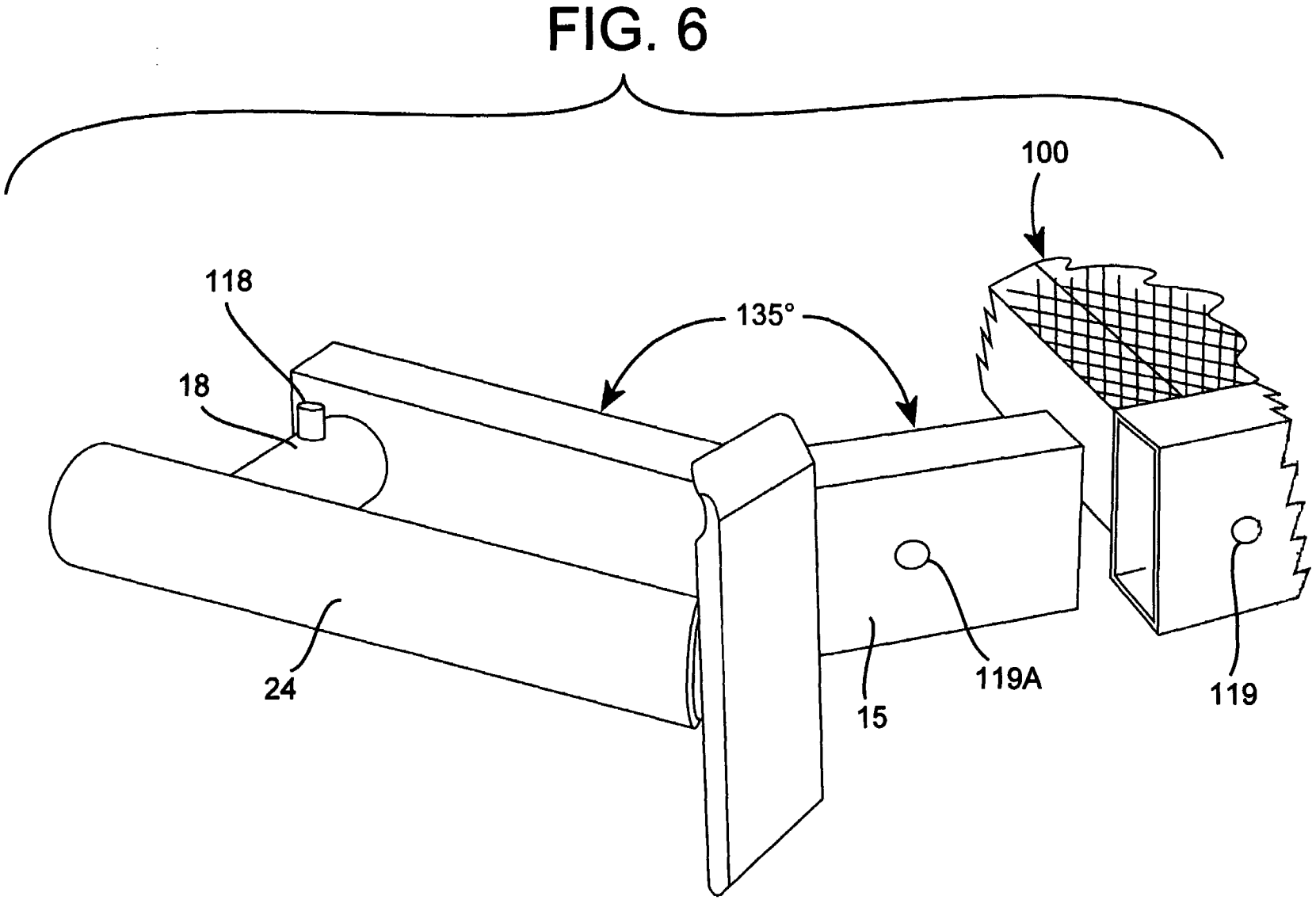
FIG. 6 is a perspective view of an angled bracket in an "in" position and a screw jack leg in a horizontal position.

Referring to FIG. 4, the adjustable attaching means is in the form of an angled tubular bracket 15 which is removably inserted and attached to said frame. The angled tubular bracket has an insertion end and an extension end attached at an angle relative to said insertion end of between 100° and 170° preferably approximately 135°. In FIG. 4 the angled tubular bracket 15 extends outwardly away from a longitudinal centerline 101 of said frame 100. The screw jack 24 is held by the frame leg support bracket 125 in a vertical position by placing T-handled pin in hole 18A of collar 18. Collar 18 connects the frame leg support bracket 125 for rotational movement on the extension end of bracket 15. In FIG. 5, the screw jack 24 is held by the frame leg support bracket 125 in a horizontal position by placing T-handled pin in hole 18B of collar 18. In FIG. 6, the angled tubular bracket 15 extends inwardly towards a longitudinal centerline 101 of said frame 100.

Figure 7:
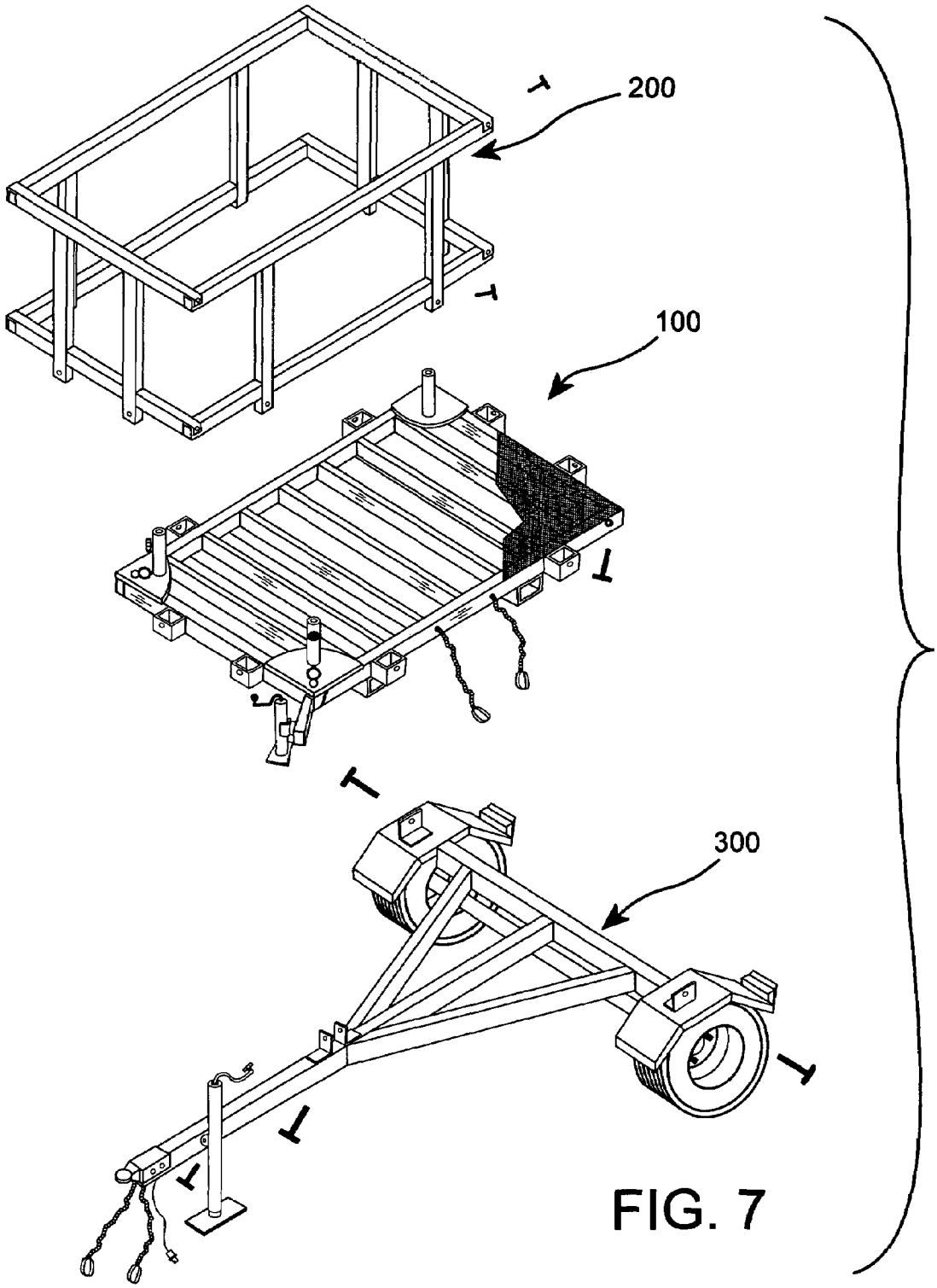
FIG. 7 is a perspective view of the main platform frame, safety rails and trailer of the present invention.

FIG. 7 shows the relative general location and orientation of the main platform frame 100, safety side rails 200 and trailer 300 prior to connection and assembly thereof.

While I have shown and described the presently preferred embodiments of my invention, the invention is not limited thereto and may be otherwise variously practiced within the scope of the following claims:

I claim:

1. A multiple task mobile working platform comprising:

a. a generally rectangular main platform frame having four corners, a pair of spaced apart tubular end members, a pair of spaced apart tubular side members and plural spaced apart cross bar members extending between said side members, said frame adapted for use in a generally horizontal orientation;

b. a respective adjustable scaffold leg member support provided near each of said four corners of said frame, each scaffold leg member support adapted to removably secure a functional vertical member of a scaffold to said frame in a selected one of a plurality of locations, said scaffold leg member support member being movable and adjustable to permit a user to selectively install a selected one of a variety of commercially available scaffolds onto the working platform;

c. an angled tubular bracket provided near each of said four corners of said frame which is removably inserted and attached to said frame, said angled tubular bracket having an insertion end and an extension end attached at an angle relative to said insertion end, said angled tubular bracket including a frame leg support bracket rotatably mounted on said extension end; and d. a frame leg in the form of an adjustable screw leveling corner jack mounted to said frame leg support bracket wherein said working platform can be leveled on uneven surfaces and wherein each frame leg can be placed in a respective scaffold leg member support member when its angular tubular bracket is angled either inwardly towards a longitudinal centerline of said frame of outwardly away from a longitudinal centerline of said frame.

2. A multiple task mobile working platform according to claim 1 wherein said frame member and said crossbar members are formed from thick steel box tubing and are welded together.

3. A multiple task mobile working platform according to claim 1 further comprising a floor member covering an upper side of said frame.

4. A multiple task mobile working platform according to claim 1 wherein said floor member is formed from a thick steel mesh.

5. A multiple task mobile working platform according to claim 1 wherein said adjustable scaffold leg member support is bolted onto said frame.

6. A multiple task mobile working platform according to claim 1 wherein said adjustable scaffold leg member support includes a base plate having an elongated opening therein and a vertically extending tubular post member adapted to receive and support a leg of a scaffold.

7. A multiple task mobile working platform according to claim 6 further comprising a screw member threaded into said tubular post member whereby turning said screw member tightens a leg of a scaffold firmly into said tubular post member and further secures a scaffold on said frame.

8. A multiple task mobile working platform according to claim 1 wherein said angled tubular bracket has an insertion end and an extension end attached at an angle relative to said insertion end of between 100° and 170°.

9. A multiple task mobile working platform according to claim 8 wherein said angle is approximately 135°.

10. A multiple task mobile working platform according to claim 1 wherein said angled tubular bracket extends outwardly away from a longitudinal centerline of said frame when inserted in a first position.

11. A multiple task mobile working platform according to claim 1 wherein said angled tubular bracket extends inwardly towards a longitudinal centerline of said frame when inserted in a second upside down position.

12. A multiple task mobile working platform according to claim 1 wherein said frame leg support bracket is attached to a frame leg having a wheel on a lower end thereof.

13. A multiple task mobile working platform according to claim 1 wherein said frame leg support bracket selectively secures a frame leg to the frame in a vertical position for use on the ground and in a horizontal position for use above the ground.

14. A multiple task mobile working platform according to claim 1 wherein said frame further comprises a pair of horizontal fork tubes mounted below the frame, said fork tubes sized and spaced to receive fork tines of a fork lift whereby the platform may be lifted above the ground by a forklift.

15. A multiple task mobile working platform according to claim 1 wherein said frame further comprises plural safety rail brackets and said platform further comprises removable safety rails.

16. A multiple task mobile working platform according to claim 1 further comprising a trailer to which the working platform can be secured for the purpose of transporting the working platform.

* * * * *